US008276951B2

(12) United States Patent
Dirnberger et al.

(10) Patent No.: US 8,276,951 B2
(45) Date of Patent: Oct. 2, 2012

(54) DOOR-CLOSING DEVICE FOR A DOMESTIC ELECTRICAL APPLIANCE

(75) Inventors: Albert Dirnberger, Neunburg v. W. (DE); Georg Spiessl, Altendorf (DE); Josef Bauriedl, Neunburg v. W. (DE); Peter Nitsche, Beilngries (DE)

(73) Assignee: emz-Hanauer GmbH & Co. KGaA (DE)

( * ) Notice: Subject to any disclaimer, the term of this patent is extended or adjusted under 35 U.S.C. 154(b) by 859 days.

(21) Appl. No.: 12/233,779

(22) Filed: Sep. 19, 2008

(65) Prior Publication Data

US 2009/0072547 A1 Mar. 19, 2009

(30) Foreign Application Priority Data

Sep. 19, 2007 (DE) ..... 10 2007 044 577

(51) Int. Cl.
*E05B 63/20* (2006.01)
*E05C 3/16* (2006.01)

(52) U.S. Cl. ..... 292/336; 292/216; 292/DIG. 69

(58) Field of Classification Search ..... 292/210, 292/216, 332, 334, 336, 341.15, 341.16, 292/341.17, DIG. 69, 97–99, 121, 123, 124, 292/127–129, 197, 202, 203, 300, 304, DIG. 26; 126/191, 197, 201
See application file for complete search history.

(56) References Cited

U.S. PATENT DOCUMENTS

| | | | | | |
|---|---|---|---|---|---|
| 727,293 | A * | 5/1903 | Coin | 292/336 |
| 1,263,358 | A * | 4/1918 | Anderson | 292/219 |
| 1,396,163 | A * | 11/1921 | Cleal et al. | 70/98 |
| 3,260,813 | A * | 7/1966 | Dargene | 200/61.64 |
| 4,351,288 | A * | 9/1982 | Gasloli | 126/197 |
| 4,907,831 | A * | 3/1990 | Di Giusto | 292/216 |
| 5,176,417 | A * | 1/1993 | Bauer | 292/201 |
| 5,419,305 | A * | 5/1995 | Hanley | 126/197 |
| 5,520,424 | A * | 5/1996 | Hapke et al. | 292/198 |
| 6,155,616 | A * | 12/2000 | Akright | 292/207 |
| 6,390,518 | B1 * | 5/2002 | Elick | 292/216 |
| 6,913,296 | B2 * | 7/2005 | Bassi | 292/122 |
| 7,032,939 | B2 * | 4/2006 | Magnusson | 292/333 |
| 2002/0056997 | A1 * | 5/2002 | Bassi | 292/226 |
| 2005/0194795 | A1 | 9/2005 | Hapke et al. | |
| 2008/0042447 | A1 | 2/2008 | Neumann | |

FOREIGN PATENT DOCUMENTS

| | | | |
|---|---|---|---|
| DE | 2756366 | A * | 6/1979 |
| DE | 102007025295 | A1 | 12/2007 |
| DE | 102006037494 | A1 | 2/2008 |
| EP | 1344486 | A2 | 9/2003 |

* cited by examiner

*Primary Examiner* — Carlos Lugo
*Assistant Examiner* — Alyson M Merlino
(74) *Attorney, Agent, or Firm* — Robert R. Deleault, Esq.; Mesmer & Deleault, PLLC

(57) ABSTRACT

A door-closing device for a domestic electrical appliance comprises a frame with an aperture for the introduction of a keeper. A closing unit is arranged on the frame such that when in a closing position, the closing unit holds the keeper for the purposed of keeping the door closed and, in an open position, releases said keeper for the purposed of opening the door, said closing unit, in the course of its transfer from the open position into the closing position, draws the keeper along with it. A closing spring arrangement acts upon the closing unit to draw the keeper along with said unit. A blocking element that is movable relative to the frame to block and unblock the movement of the closing unit.

10 Claims, 7 Drawing Sheets

DOOR-CLOSING DEVICE FOR A DOMESTIC ELECTRICAL APPLIANCE

CROSS-REFERENCE TO RELATED APPLICATIONS

This application claims the benefit of German Patent Application No. DE 10 2007 044 577.8, filed Sep. 19, 2007, in the German Patent Office.

BACKGROUND OF THE INVENTION

1. Field of the Invention

The present invention relates to a door-closing device for a domestic electrical appliance. Particularly, the present invention relates to a door-closing device comprising a frame with an aperture for the introduction of a keeper or the like, a closing unit which is arranged on the frame so as to be movable, relative to the latter, and which, in a closing position, holds the keeper fast for the purpose of keeping the door closed and, in an open position, releases the keeper for the purpose of opening the door, the closing unit, in the course of its transfer from the open position into the closing position, drawing the keeper along with it along part of the keeper's path of movement, relative to the frame, a closing spring arrangement which acts upon the closing unit and which supplies the force necessary for drawing the keeper along with the unit, and a blocking system by which the closing unit can be blocked from moving out of the open position and into the closing position, it being possible to set aside the blocking of the closing unit by relative movement of said blocking system and closing unit.

2. Description of the Prior Art

A door-closing device of this kind with a pulling-shut function, that is to say spring-assisted pulling-shut of the door, is known, for example, from US 2005/0194795 A1. In this known solution, a blocking pin is provided which is arranged so as to be integral with the frame. The closing unit comprises a linearly movable carriage on which a rotary member is held so as to be movable about an axis of rotation. An arrangement of a number of helical compression springs is inserted between the carriage and a framework belonging to the door-closing device. The force of the helical compression springs pretensions the rotary member towards the blocking pin. The rotary member possesses a slot which is open in the radially outward direction and into which, when the closing unit is in the open position, the keeper moves on closure of the door. In the process, the keeper strikes against one of the flanks of the slot. This action of the keeper upon the rotary member leads to rotation of the latter about the axis of rotation, the outer peripheral face of said rotary member sliding along the blocking pin. Under these circumstances, considerable frictional forces can operate between the blocking pin and the rotary member, depending upon the firmness of the helical compression springs. While the keeper which has been introduced is rotating the rotary member, that part of said rotary member which adjoins the other flank of the slot engages in a clearance in the keeper. As soon as an edge at which the outer peripheral face of the rotary member bends away in the radially inward direction slips past the blocking pin, the helical compression springs are able to expand and thrust the carriage away. In the course of this displacement of the carriage, the keeper is drawn along with the rotary member by the latter, which now presses, with the other flank of its slot, against said keeper.

Another door fastener with a pulling-shut function, which door fastener is not a generic one however, is known from EP 1 344 486 A2. In this door fastener, a rotary member, to which a helical compression spring which supplies the pulling-shut force is attached by one of its ends, serves as the closing unit. When the fastener is in an open state, the straight line of force extending between the points at which the helical compression spring is attached lies on one side of the axis of rotation of the rotary member and pretensions the latter in the direction of an open position. When the fastener is closed, the straight line of force of the helical compression spring moves away over the axis of rotation of the rotary member and comes to rest on the other side of said axis of rotation. The pretensioning action of the helical compression spring is then in the direction of the closing position of the rotary member. In order to close the door, it is therefore first necessary to operate against the force of the helical compression spring. This comes about through the fact that a keeper which has been introduced strikes against one of the flanks of a slot constructed in the rotary member and thereby moves the latter away over the dead centre at which the straight line of force of the helical compression spring passes precisely through the axis of rotation. As soon as the dead centre has been crossed, the spring expands and drives the rotary member into its closing position. In the process, the keeper which is now trapped in the slot in the rotary member is drawn along with it. What is problematic about the fastener according to EP 1 344 486 A2 is that, for a low initial force of resistance when the door is being closed, the straight line of force of the helical compression spring is supposed to be removed only a little way from the dead-centre position, but this at the same time entails an increased susceptibility to unwanted automatic closing of the catch if vibration or jolting occurs.

German Laying-Open Specification DE 10 2006 037 494 A1, which was published subsequently, indicates a door-closing device with a pulling-shut function in which, on closure of the door, a closing body with a projecting nose plunges into a closing trough formed on the door and then snaps back under the action of an expanding closing spring, as a result of which the door is pulled shut. Said door first of all strikes against a control lever which is separated from the closing body and which is set in motion as a result. The rotating control lever in turn presses the closing body down against a blocking face formed by a base frame of the closing device. As soon as the closing body passes the blocking face, the closing spring is able to expand.

German Laying-Open Specification DE 10 2007 025 295 A1, which was likewise published subsequently, indicates a door fastener having a closing member which is guided, via two spindles, so as to be movable within a guide groove in a fastener housing and which, on closure of the door, grasps a closing catch arranged on the door and then moves, under the action of an expanding closing spring, in such a way that the door catch is pulled into the fastener. The course of the guide groove exhibits an inflexion which has to be overcome by one of the spindles of the closing member so that the closing spring is able to expand for the purpose of deploying its pulling-shut action.

SUMMARY OF THE INVENTION

The object of the invention is to provide a door-closing device of the type initially referred to, which can be closed with high functional reliability and little expenditure of force and which, in addition, can preferably provide high holding power when in the closed state.

In order to achieve this object, a door-closing device of generic type is characterised, according to the invention, in that the blocking system is formed by a blocking element which is arranged so as to be movable, relative to the frame, between a blocking position and a releasing position and which, in the blocking position, prevents a movement of the closing unit out of the open position and into the closing position and, in the releasing position, permits such a movement of the closing unit, and that the blocking element is constructed and arranged in such a way that it can be lifted by the keeper out of its blocking position and into its releasing position, against the action of a restoring force, on closure of the door.

The door-closing device according to the invention can be used, for example, in washing machines, dishwashers or tumble driers. When it is introduced into the aperture in the frame, the keeper, which is constructed, for example, with a leading transverse stud, lateral cheeks adjoining the latter and a gripping recess, which lies behind said transverse stud and between the lateral cheeks, for a gripping section of the closing unit, impinges upon the blocking element and lifts the latter out of its blocking position and into the releasing position. As a result of this, the closing unit becomes free and is able to move into the closing position under the action of the closing spring arrangement. It is thus possible, with simple means, to guarantee high stability of the blocking arrangement which is not susceptible to shaking or vibrating influences. At the same time, a design which permits unblocking of the closing unit with comparatively little expenditure of force is also possible.

According to one further development of the invention, the closing unit may, when the door-closing device is in a state preparatory to closing, prior to the introduction of the keeper into the aperture in the frame, be in blocking abutting contact with the blocking element, said closing unit being constructed and arranged in such a way that, on closure of the door, said unit is initially lifted by the keeper out of blocking abutting contact with said blocking element in the direction away from the closing position, before said keeper forces the blocking element into its releasing position. In this configuration, the blocking element is first of all relieved of load through the fact that the keeper which has been introduced drives the closing unit out of the open position and slightly in the direction away from the closing position, and therefore out of abutment against the blocking element. In its open position, the closing unit accordingly possesses a certain degree of mobility in the direction away from its closing position. In this context, "open position" means that position of the closing unit which it normally assumes when the door is open. The relieving of the load on the blocking element as a result of deflection of the closing unit by the incoming keeper then facilitates the lifting-out of the blocking element and thus the closing operation as a whole.

The provision of a blocking element which can be moved separately and the actuation of said element by the keeper also permit reliable identification of the state of the door (i.e. open or closed). An electrical switch, which interacts with the blocking element and the switching state of which depends upon the position of said element, may be provided for this purpose. Under these circumstances, the closing unit and blocking element are advantageously constructed and arranged in such a way that, when the closing unit is in the closing position with the keeper absent, the blocking element at least approximately assumes its blocking position.

If, in this configuration, the blocking element is lifted, when the door is open, out of its blocking position either inadvertently or intentionally, for instance by a playing child who penetrates the frame with an object through the aperture in said frame, the closing unit which has now been released admittedly turns over into its closing position. However the blocking element is able, when the playing child lets go of it again, to return to its blocking position in which the electrical switch assumes the same switching state as when the door-closing device is in the normal, open state. Although, therefore, the closing unit has passed over into its closing position, the electrical switch nevertheless continues—correctly—to indicate an open door. Only when the door has actually been closed and the keeper has been introduced into the aperture in the frame is the blocking element held in its releasing position by the keeper. The switch then correctly indicates the closed state of the door.

The blocking element is preferably formed by a blocking lever which is mounted so as to be pivotable, relative to the frame. Alternatively, said blocking element may be formed, for example, by a blocking slide which is guided so as to be movable in a linear manner, relative to said frame. In these cases, a separate pretensioning element which generates the restoring force is expediently associated with the blocking element.

The blocking element may also alternatively be formed, according to one variation, by a flexible blocking body. In this case, it is possible to dispense with an additional pretensioning element for generating the restoring force; the restoring force may be generated by the blocking body itself in the course of its elastic deflection. Said blocking body may, for example, be produced from spring steel sheet.

The closing unit may be formed by a rotary member which is rotatable about an axis of rotation which is stationary, relative to the frame, and the axis of rotation of which member extends at a radial distance from the path of movement of the keeper, relative to the frame. Under these circumstances, the rotary member preferably has a radially protruding gripping section which grasps the keeper, on closure of the door, and draws said keeper along with itself while rotating the rotary member, the movement of the gripping section after the grasping of the keeper possessing a substantial, in particular predominant, component in the direction of the path of movement of the keeper. In this way, a major tractive force can be exerted on said keeper by the rotary member.

The closing spring arrangement may comprise at least one spiral spring which acts upon the rotary member and is loaded in tension or compression and the straight line of force of which, observed in a section normal to the axis, always lies on the same side of the axis of rotation, but is at a smaller radial distance from said axis of rotation in the open position than in the closing position. This is advantageous in so far as the radial distance of the straight line of force from the axis of rotation, which distance is becoming increasingly greater, permits great closing force when the door is being closed. This is favourable for leakproof and secure closing of the door.

As an alternative to a spiral spring which is loaded in tension or compression, the closing spring arrangement may comprise, for example, at least one torsion spring that acts upon the rotary member.

Irrespective of its actual mobility (whether rotatable or of another kind) in relation to the frame, the closing unit is preferably formed by a single closing body, the said closing body having a gripping section which grasps the keeper, on closure of the door, and draws said keeper along with itself while moving the closing body. Under these circumstances, the movement of the gripping section after the grasping of the keeper possesses an at least predominant component in the direction of the path of movement of said keeper, a fact which—as has already been alluded to above—is favourable for a high tractive force upon the keeper.

BRIEF DESCRIPTION OF THE DRAWINGS

The invention will be explained in greater detail below with the aid of the appended drawings, in which.

DETAILED DESCRIPTION OF THE PREFERRED EMBODIMENT

Figure 1:
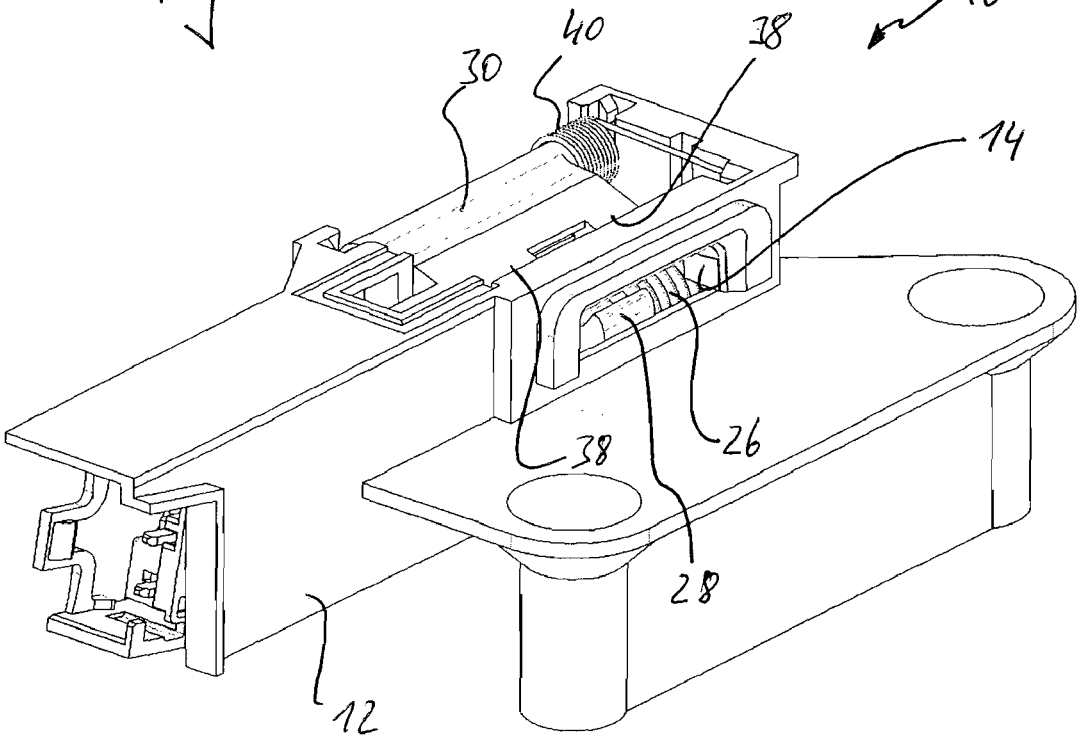
FIGS. 1 and 2 represent perspective views of a door-closing device according to a first exemplified embodiment.
Figure 2:
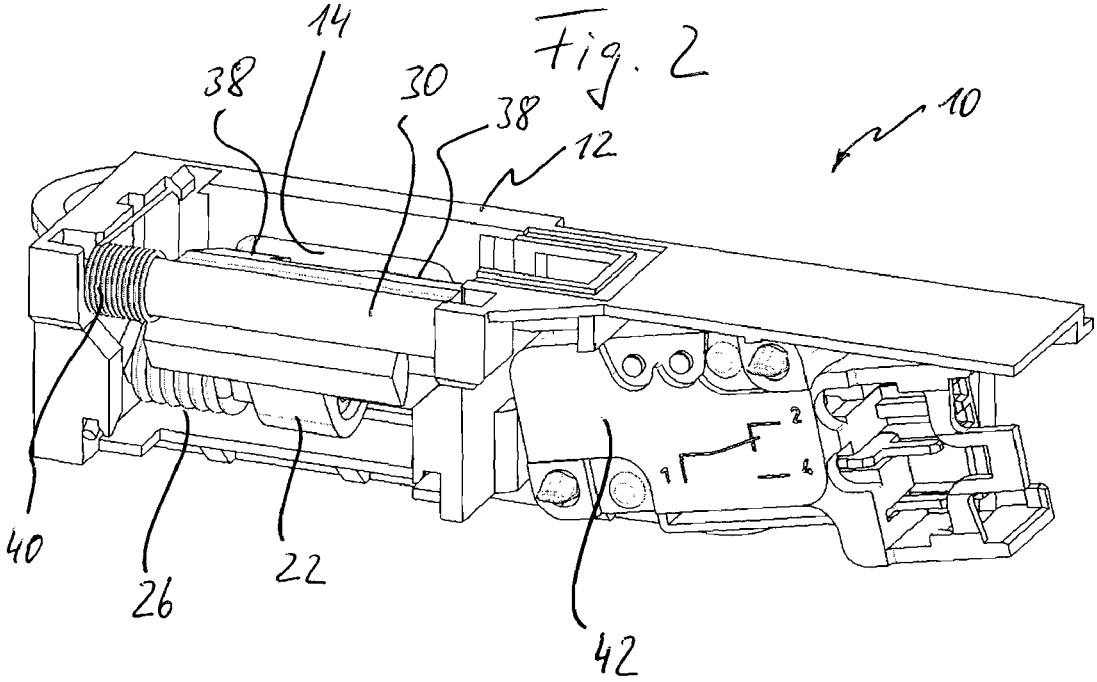
Figure 3:
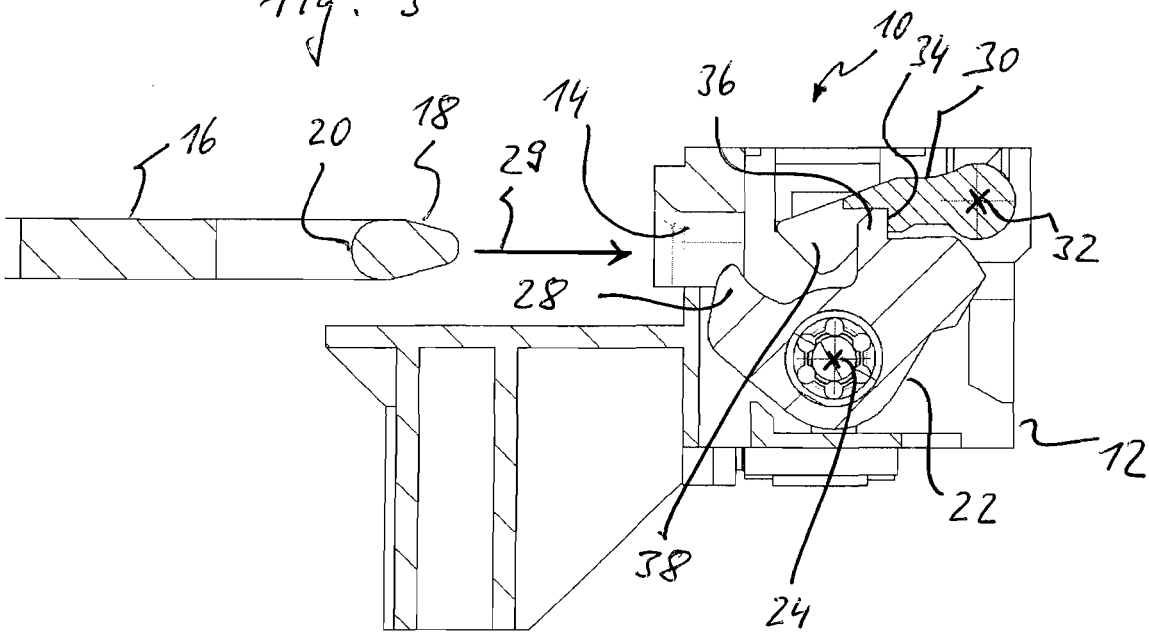
FIG. 3 represents a sectional view of the door-closing device in FIGS. 1 and 2, in a state preparatory to closing.

For the purpose of explaining the first exemplified embodiment, reference will initially be made, in particular, to FIGS. 1 to 3. A door-closing device, which is designated generally by 10, is shown therein in a state preparatory to closing, in which it is being prepared for closing the door of a domestic electrical appliance, for instance a washing machine or a dishwasher. The door-closing device 10 comprises a framework 12 on which various other components of said device are mounted and which, according to one variant, is intended and constructed for installation in the main housing of the domestic appliance. Said framework 12 possesses an aperture 14 into which a keeper (door catch) 16, which in this variant is located on the door, moves on closure of the door of the domestic appliance. The keeper 16 possesses a point 18 behind which a gripping clearance 20 is located. In the sectional representation in FIG. 3, it can be seen that the point 18 of the keeper possesses lateral flanks that run towards one another obliquely.

In another variant, the framework 12 is mounted, by means of its installing components, on the door of the domestic appliance, while the keeper 16 is fitted to the main housing of said appliance. The door serves to occlude an aperture through which a working space provided in the main housing of the appliance is accessible for the purpose of receiving dishes, washing or the like. In many cases, a so-called "door seal", which is compressed to a greater or lesser extent when the door is closed, will extend around the access aperture. This door seal may be fitted to the door or to the main housing of the appliance. For the purpose of compressing the door seal, a force is necessary which is applied, at least partially, by the door-closing device 10 itself, namely by spring means which will be described in greater detail later on and which expand on closure of the door and, in the process, pull said door towards the main housing of the appliance.

Figure 4:
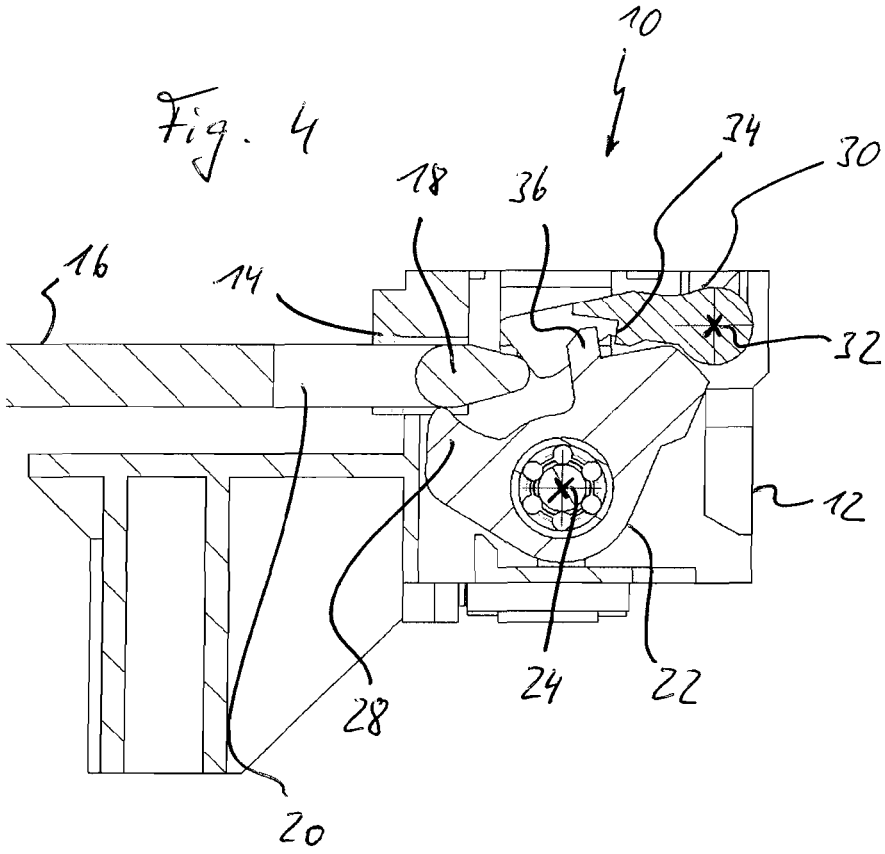
FIG. 4 represents a sectional view of the door-closing device in FIGS. 1 and 2, during a closing operation.
Figure 5:
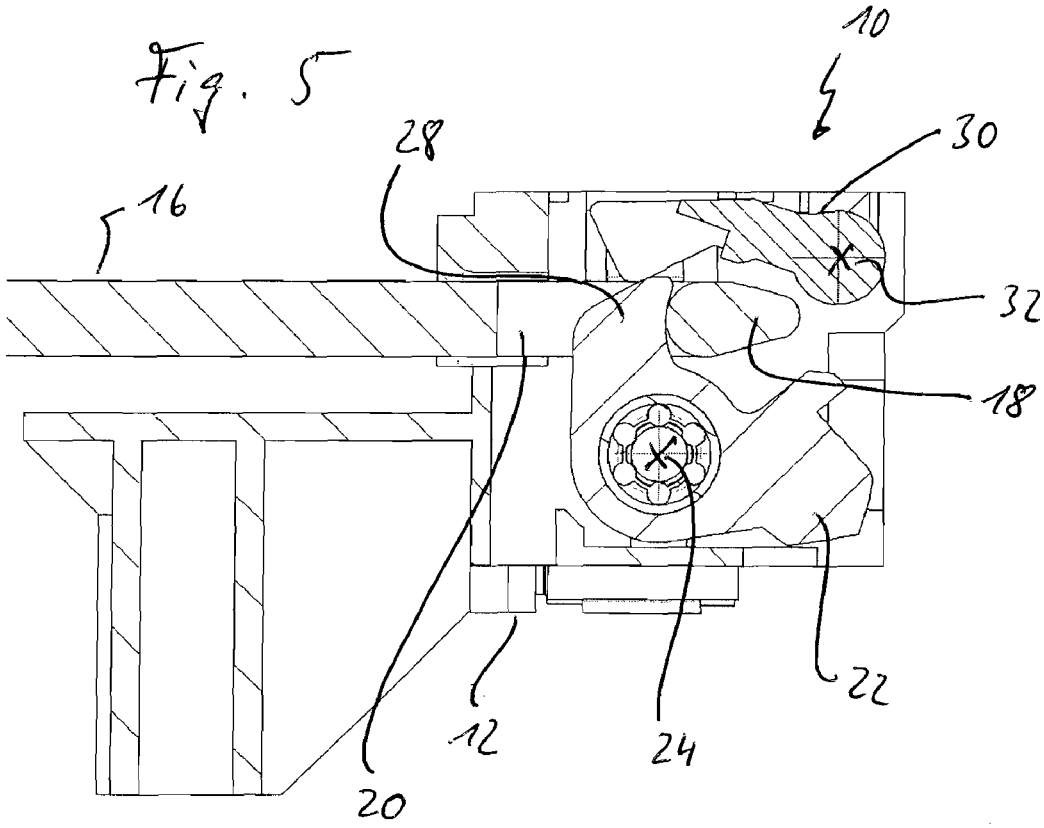
FIG. 5 represents a sectional view of the door-closing device in FIGS. 1 and 2, after the door has been closed.
Figure 6:
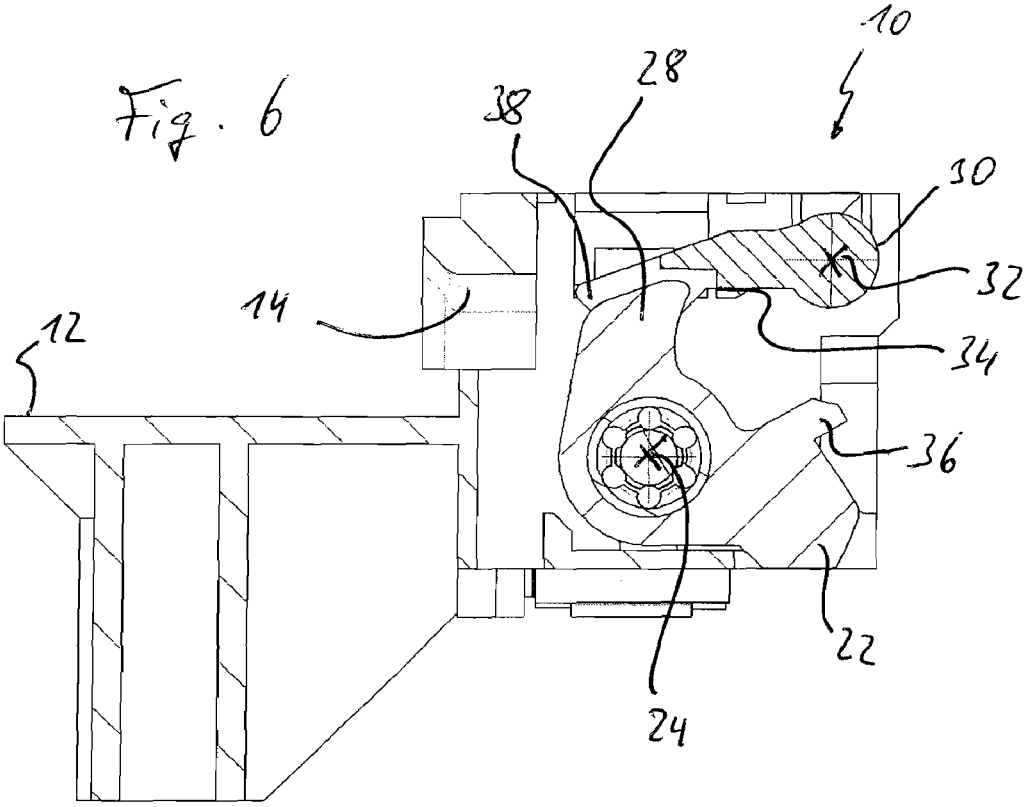
FIG. 6 represents a sectional view of the door-closing device in FIGS. 1 and 2, in a closing state without the keeper introduced.
Figure 7:
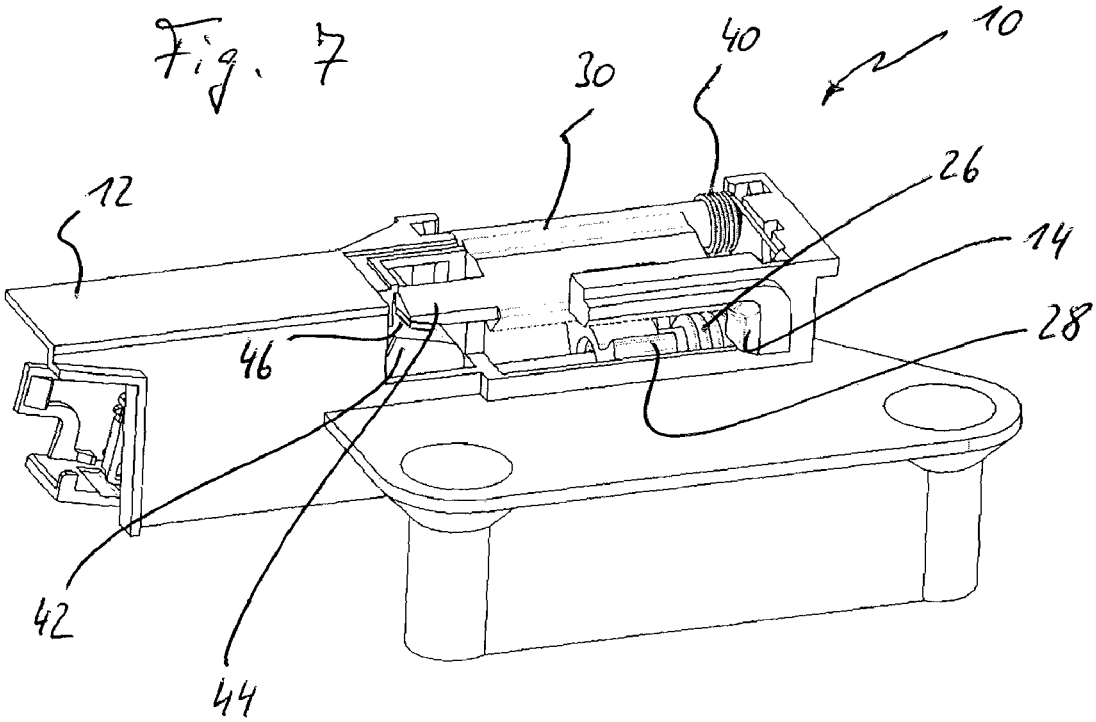
FIGS. 7 and 8 represent partially cut-away perspective views of the door-closing device in FIGS. 1 and 2 for the purpose of illustrating the dependence of the switching state of an electrical switch upon the position of a blocking element belonging to the door-closing device.

A rotary member 22 which serves as the closing unit is held on the framework 12 so at to be rotationally movable about an axis of rotation 24 which is integral with the frame. In the state preparatory to closing according to FIG. 3, the rotary member 22 is in a so-called "open position", from which it can be rotated in the clockwise direction into a closing position which is shown in FIG. 5. In addition to this, the rotary member 22 can be deflected out of the open position in FIG. 3 in the anticlockwise direction by a small amount and into the rotational position shown in FIG. 4. In each rotational position, the rotary member 22 is pretensioned by a closing spring 26 in the direction of the closing position according to FIG. 5. In the exemplified embodiment in FIGS. 1 to 8, said closing spring 26 is formed by a spiral spring which acts as a leg spring, i.e. is loaded in rotation, and the axis of which substantially coincides with the axis of rotation 24 of the rotary member 22.

Rotary member 22 possesses a radially protruding gripping or entraining section 28 which, in the open position according to FIG. 3, projects slightly into the path of movement of the keeper 16, namely in such a way that said keeper 16, when it moves into the frame aperture 14 (i.e. on closure of the door), impinges upon the gripping section 28 with the lower oblique flank of its point 18. This brings about the aforementioned slight deflection of the rotary member 22 into the rotational position according to FIG. 4.

The path of movement of the keeper 16, relative to the frame 12 and therefore relative to the rotary member 22 which is held in said frame 12, is indicated by an arrow 29 in FIG. 3. Although the door will normally be fitted to the main housing of the appliance in a pivotingly movable manner, the relative path of movement of the keeper 16 can be regarded as being approximately rectilinear on a small scale, i.e. over short distances, even if, on the whole, it follows a circular path. That is why the arrow 29 is drawn in as a straight arrow in FIG. 3.

The path of movement of the keeper 16, relative to the frame 12, extends at a radial distance from the axis of rotation 24 of the rotary member 22. This becomes clear if the arrow 29 in FIG. 3 is imagined as being prolonged; it then runs past said axis of rotation 24 at a radial distance above the latter.

In the open position according to FIG. 3, the rotary member 22 is prevented by a blocking lever 30 from rotating into the closing position according to FIG. 5. Said blocking lever 30 is held on the framework 12 so as to be pivotingly movable about an axis of pivoting 32 extending parallel to the axis of rotation 24. It possesses a blocking shoulder 34 with which a radially projecting nose 36 on the rotary member 22 interacts. Said blocking lever 30 possesses axially, on either side of the blocking shoulder 34, extensions 38 with which the keeper 16 interacts on closure of the door. The nose 36 on the rotary member 22 moves freely between said extensions 38 on the blocking lever 30.

The blocking lever 30 is pivotingly movable between a blocking position which is shown in FIG. 3 and a releasing position which is shown in FIG. 5. A pretensioning element 40 which is constructed, in this case, as a leg spring pretensions the blocking lever 30 in the direction of its blocking position according to FIG. 3. The end faces of its extensions 38 form contact surfaces for the keeper 16 which, on moving into the aperture 14 in the frame, strikes against the said end faces with its point 18, as is shown in FIG. 4. If the keeper 16 is then advanced further, it presses the blocking lever 30 upwards out of the blocking position and in the direction of the releasing position against the force of the pretensioning spring 40. This state is shown in FIG. 5.

In the releasing position, the blocking shoulder 34 is moved radially out of the range of the nose 36 on the rotary member 22, so that the latter is able to rotate unhindered into its closing position. However said rotary member 22 moves into its closing position only when the keeper 16 has moved into the aperture 14 in the frame sufficiently far for the gripping section 28 of the rotary member 22 to be able to plunge into the gripping clearance 20 in the keeper 16. As soon as the gripping section 28 engages in the gripping clearance 20, the rotary member 22, in the course of its rotation into the closing position, pulls the keeper 16 deeper into the aperture 14 in the frame. The force needed for this pulling-shut movement is applied by the closing spring 26, which expands as the rotary member 22 moves from the open position into the closing position.

When the rotary member 22 rotates, the gripping section 28 follows a circular path. During the phase in which the gripping section 28 is in entraining engagement with the keeper 16, said gripping section 28 moves along one such part of the said circular path, on which part it has a substantial, in particular predominant, component in the direction of the path of movement of the keeper 16, that is to say in the direction of the arrow 29. As a result of this, the rotary member 22 is able to exert a comparatively high entraining force upon the keeper 16 in the direction of the arrow 29. This force may, at the same time, bring about, or at least assist in, the compression of a door seal which may optionally be present on the domestic appliance.

In the closing state according to FIG. 5, the blocking lever 30 continues to be held in its releasing position by the keeper 16. Under these circumstances, the extensions 38 on the blocking lever 30 are supported, in a manner of which no further details are represented, against side walls which laterally delimit the gripping clearance 20 in the keeper 16.

On closure of the door, there first of all takes place the deflection of the rotary member 22 into the position according to FIG. 4, as a result of which the abutting contact between the nose 36 and the blocking shoulder 34 is set aside. This relieves the load on the blocking lever 30, a fact which facilitates the subsequent lifting-out of the latter by the keeper 16. It should be pointed out, of course, that it is possible, according to one variation, to dispense with prior deflection of the rotary member 22 for the purpose of terminating the abutting contact with the blocking lever 30. In this variation, the keeper 16 moves past the gripping section 28 on being introduced into the aperture 14 in the frame, without coming into deflecting contact with said gripping section and pressing it downwards. The lifting-out of the blocking lever 30 by means of the keeper 16 which is moving in then takes place, without any change, in the manner which has been described so far, although of course the abutting contact that continues to exist between the nose 36 and the blocking shoulder 34 leads, under certain circumstances, to increased, friction-induced resistance.

Situations can be conceived of in which the rotary member 22 passes into its closing position without closing the door in the process. This can happen, for example, if a child is playing with the door-closing device and sticks an object into the aperture 14 in the frame. If the child strikes against the blocking lever 30 sufficiently hard, the possibility of the rotary member 22 being released and rotating into its closing position cannot be ruled out. In such an event, the blocking lever 30 can return, after the playing child has let go of it again, to its blocking position without colliding with the rotary member 22. As can be clearly seen in FIG. 6, after the return of the blocking lever 30 into the blocking position, the gripping section 28 of the rotary member 22 is located in the clear space formed between the extensions 38 on said blocking lever 30. Reciprocal obstruction of the rotary member 22 and blocking lever 30 does not take place in this state.

Figure 8:
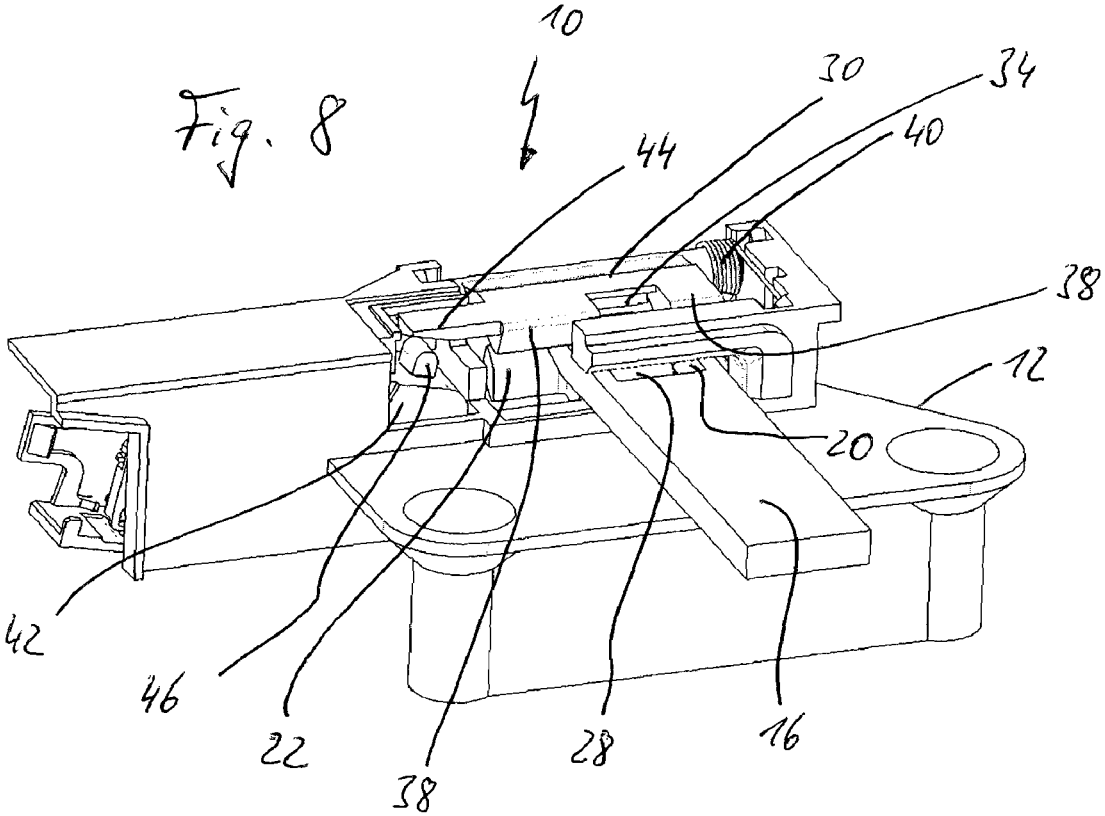
Figure 9:
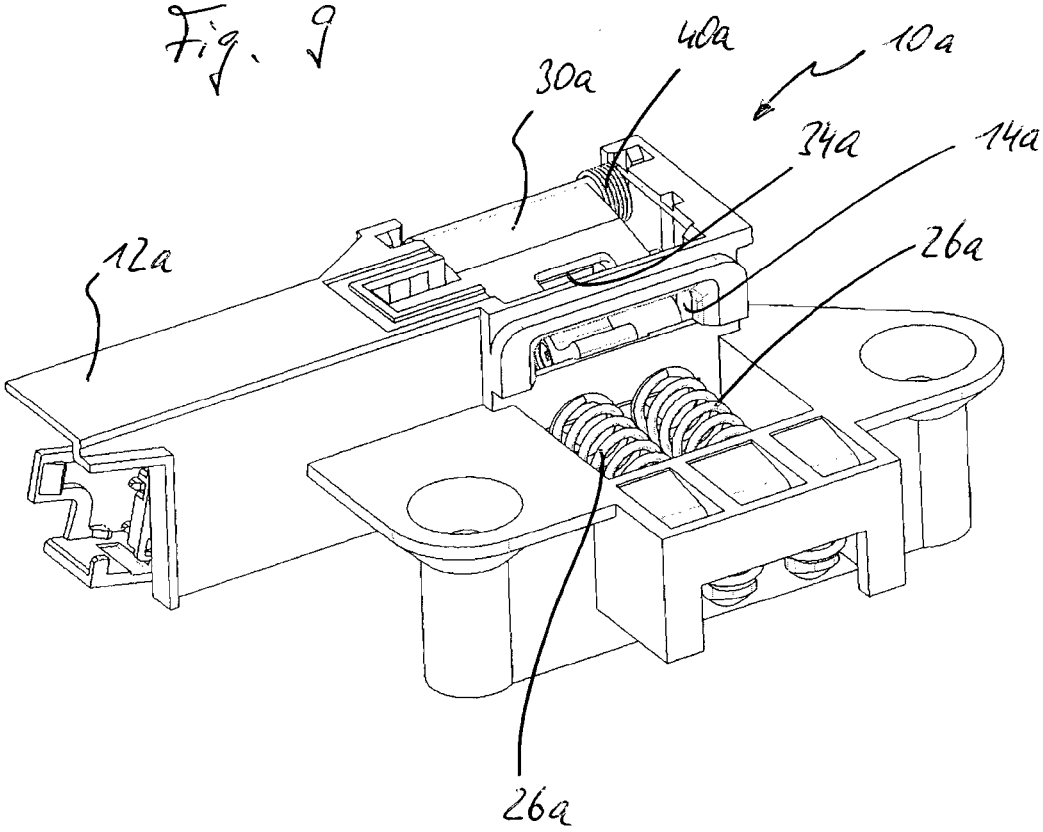
FIGS. 9 and 10 represent perspective views of a door-closing device according to a second exemplified embodiment.
Figure 10:
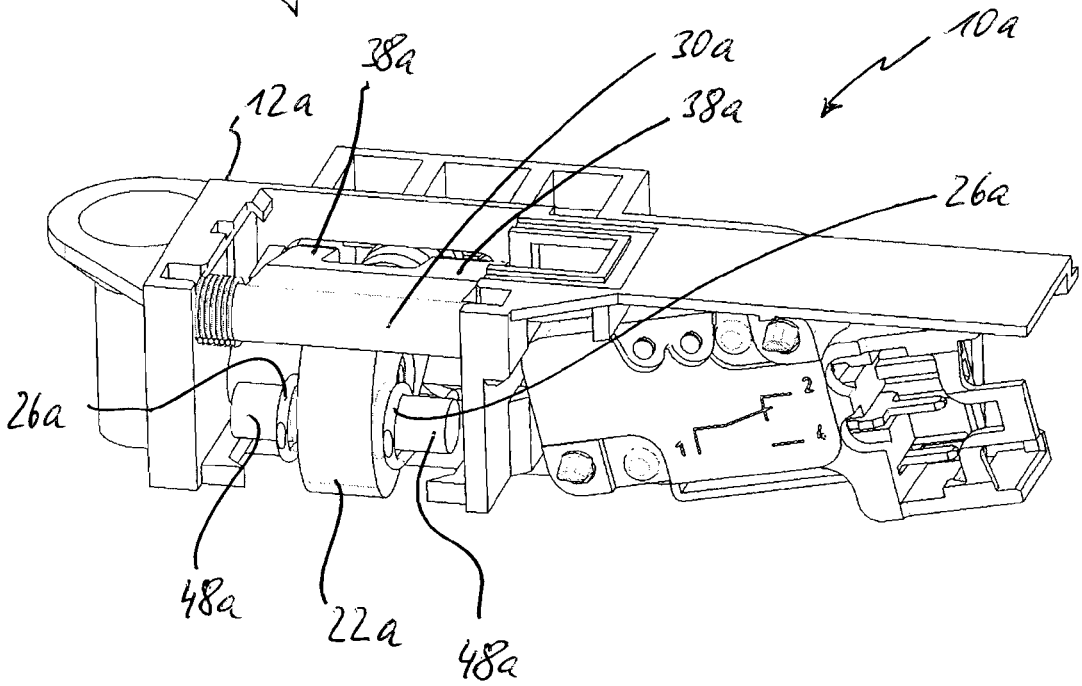

The ability of the blocking lever 30 to still return substantially into its blocking position after irregular actuation of the rotary member 22 (in this case, "irregular" means: without the introduction of the keeper 16) can advantageously be utilised in conjunction with an electrical switch that indicates the closing state of the door-closing device. A switch of this kind is shown at 42 in FIG. 2. In addition, it can be seen, in FIGS. 7 and 8, that the blocking lever 30 possesses an actuating section 44 which is constructed here as an arm which projects away laterally and which serves to actuate a mechanical sensor 46 belonging to the electrical switch 42. In the state according to FIG. 7, the blocking lever 30 assumes its blocking position. In this state, the actuating section 44 presses the sensor 46 down, a fact which corresponds to a first switching state of the electrical switch 42. In FIG. 8, on the other hand, the blocking lever 30 is located in its releasing position in which it is held by the keeper 16 which has been introduced. In this state, the actuating section 44 no longer presses on the sensor 46, a fact which corresponds to a second switching state of the electrical switch 42. The switching state of said electrical switch 42 accordingly gives reliable information as to whether the door is closed or open. For only when the door is actually closed does the blocking lever 30 remain in its releasing position; without the keeper 16 introduced, it returns at least approximately to its blocking position, at any rate after the door-closing device has been left alone again.

As an alternative to an inherently rigid blocking element, the blocking element may conceivably be manufactured from a flexible material, say from a piece of spring steel sheet. In such a case, it is possible to dispense with a separate pretensioning spring for said blocking element.

For the purpose of explaining the second exemplified embodiment, reference will now be made to FIGS. 9 to 13. In said second exemplified embodiment, components which are identical or which have an identical action are provided with the same reference symbols as before, but with the addition of a lower-case letter. In order to avoid unnecessary repetitions, the reader is referred to the above description of the first exemplified embodiment, provided that nothing to the contrary arises below.

Figure 11:
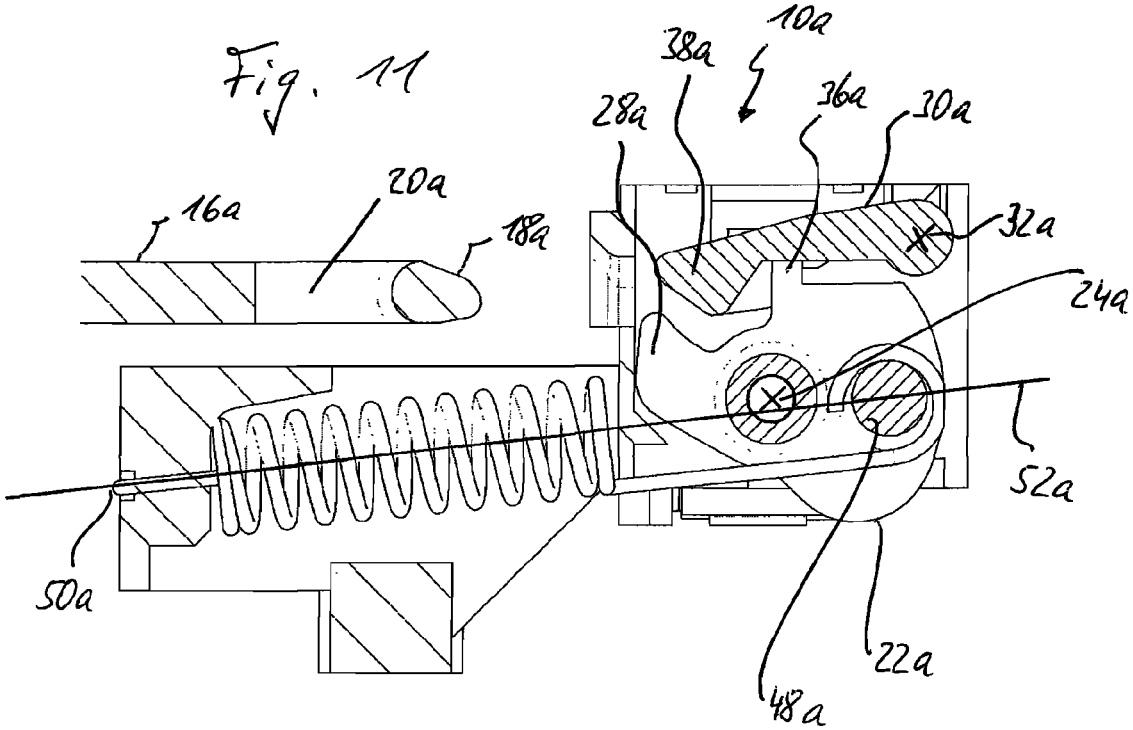
FIG. 11 represents a sectional view of the door-closing device in figures 9 and 10, in a state preparatory to closing.
Figure 12:
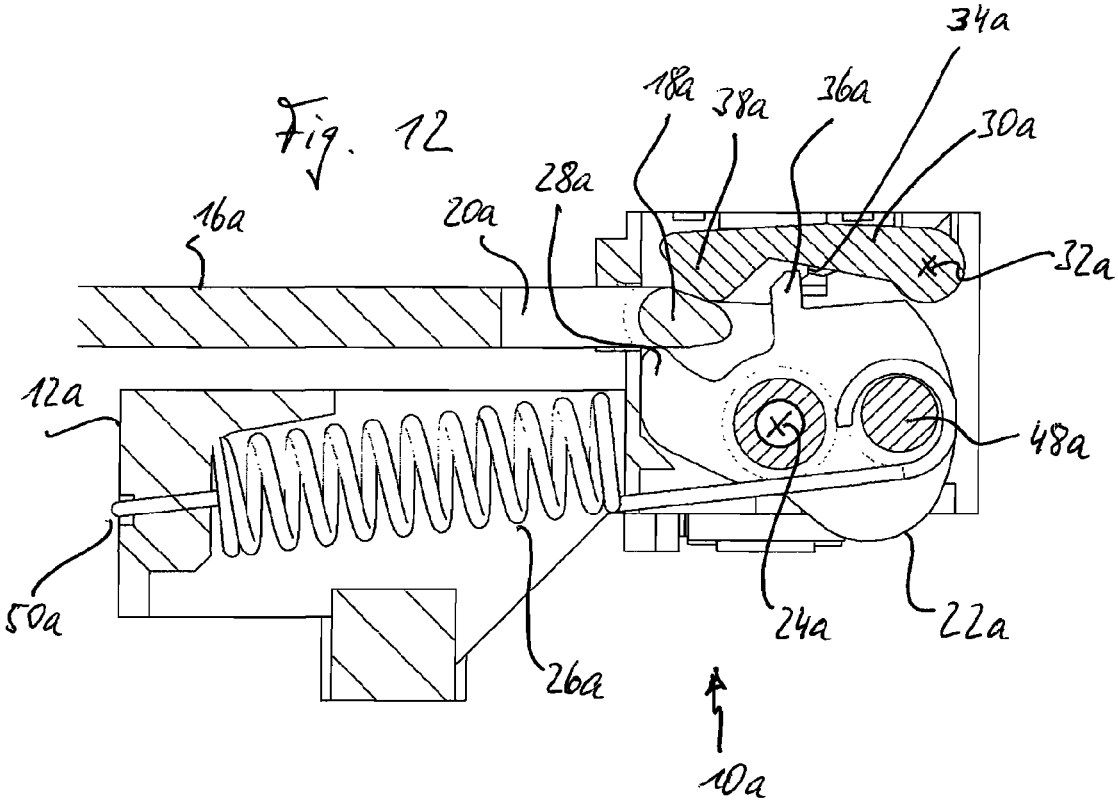
FIG. 12 represents a sectional view of the door-closing device in figures 9 and 10, during a closing operation.
Figure 13:
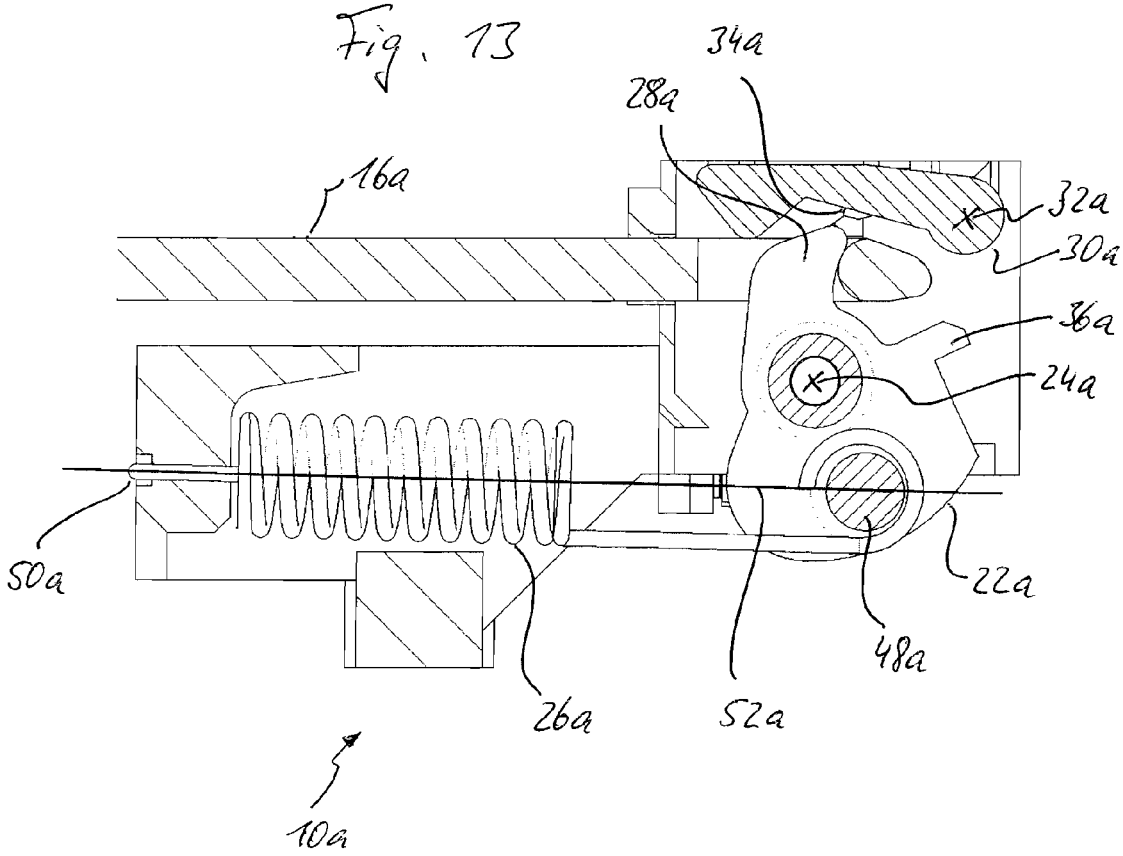
FIG. 13 represents a sectional view of the door-closing device in FIGS. 9 and 10, with the door closed.

The exemplified embodiment in FIGS. 9 to 13 differs from the first exemplified embodiment substantially as a result of a different way of generating the spring pretensioning for the rotary member 22*a*. In concrete terms, two helical draw springs 26*a* serve to generate the said pretensioning. The rotary member 22*a*, which is of disc-like design, is designed, on each of its axial sides, with an axially protruding peg 48*a* which is arranged eccentrically to the axis of rotation 24*a* and to which one of the helical draw springs 26*a* is attached, in each case, by one of its ends. At their other ends, the two helical draw springs 26*a* are attached to the framework 12*a* in each case, as is indicated at 50*a* in FIGS. 11 to 13. The drawing action of each of the helical draw springs 26*a* extends along a straight line which connects the two points of attachment of the helical draw spring 26*a* in question to the framework 12*a* and to the rotary member 22*a*. In FIGS. 11 and 13, a straight line of this kind is indicated at 52*a*. It will also be referred to below as the "straight line of force" of the helical draw spring 26*a* in question.

The location of the straight line of force 52*a* of each helical draw spring 26*a* varies with respect to the axis of rotation 24*a* on account of the variable rotational position of the rotary member 22*a* when the door is opened and closed, and the eccentricity of the attachment pegs 48*a*. In concrete terms, the straight line of force 52*a* moves within a plane which extends transversely, and in particular normally, to the axis of rotation 24*a*, said straight line of force always lying on the same side of the axis of rotation 24*a* and always being at a radial distance from the latter. In the state preparatory to closing according to FIG. 11 (which corresponds to the open position of the rotary member 22*a*), this radial distance is comparatively small, whereas in the closing state according to FIG. 13 (which corresponds to the closing position of said rotary member 22*a*), the radial distance between the straight line of force 52*a* and the axis of rotation 24*a* is substantially greater. Although the helical draw springs 26*a* are tensioned more weakly when the door-closing device is in the closing state than when it is in the state preparatory to closing, a comparatively large closing momentum, which guarantees reliable, leakproof closing of the door, is nevertheless operative because of the larger radial distance of the straight line of force 52*a* from the axis of rotation 24*a*. On the other hand, the operative torque exerted by the helical draw springs 26*a* on the rotary member 22*a* is comparatively small, when the door-closing device is in the state preparatory to closing, on account of the smaller radial distance of the straight line of force 52*a* from the axis of rotation 24*a*, although the helical draw springs 26*a* are under stronger tension than in the closing state. This is advantageous, among other things, for gentle opening of the door.

In the second exemplified embodiment too, as in the first, the keeper 16*a* can initially, on moving into the aperture 14*a* in the frame, easily deflect the rotary member 22*a* out of its open position and in the direction away from the closing position, in order to thus set aside the abutting contact between the nose 36*a* on the rotary member 22*a* and the blocking shoulder 34*a* on the blocking lever 30*a*, before the keeper 16*a* presses said blocking lever 30*a* up into its releasing position. Even in the case of such prior deflection of the rotary member 22*a*, the straight line of force 52*a* of each helical draw spring 26*a* remains at a certain radial distance from the axis of rotation 24*a*, so that pretensioning in the direction of the closing position is operative in any rotational position of said rotary member 22*a*. It is obviously possible, of course, even in the case of the second exemplified embodiment, to dispense with the prior slight deflection of the rotary member 22*a* if desired.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door-closing device for a domestic electrical appliance, the device comprising:

a frame with an aperture for the introduction of a keeper;

a closing unit which is arranged on the frame so as to be movable, relative to the latter, between an open position and a closing position and which, in the closing position, holds the keeper fast for the purpose of keeping a door closed, the closing unit, in the course of its transfer from the open position into the closing position, drawing the keeper along with it along part of the keeper's path of movement, relative to the frame;

a closing spring arrangement which acts upon the closing unit and which supplies the force necessary for drawing the keeper along with the unit; and a blocking system blocking the closing unit from moving from the open position to the closing position, it being possible to unblock the closing unit by relative movement of the blocking system and the closing unit;

wherein the blocking system is formed by a blocking element which is arranged so as to be movable, relative to the frame, between a blocking position and a releasing position and which, in the blocking position, prevents a movement of the closing unit from the open position to the closing position and, in the releasing position, permits such a movement of the closing unit, and that the blocking element is constructed and arranged in such a way that the blocking element is directly engaged by the keeper upon closure of the door whereby the blocking element is lifted out of its blocking position and into its releasing position against the action of a restoring force.

2. The door-closing device according to claim 1, wherein, when the door-closing device is in a state preparatory to closing, prior to the introduction of the keeper into the aperture in the frame, the closing unit is in blocking abutting contact with the blocking element, and that said closing unit is constructed and arranged in such a way that, on closure of the door, said unit is initially lifted by the keeper out of blocking abutting contact with said blocking element in the direction away from the closing position, before said keeper forces the blocking element into its releasing position.

3. The door-closing device according claim 1, wherein the closing unit moves out of the open position and into the closing position exclusively under the force of the closing spring arrangement.

4. The door-closing device according to claim 1, wherein, in any position of the closing unit, the closing spring arrangement exerts a force which brings about pretensioning of said closing unit in the direction of its closing position.

5. The door-closing device according to claim 1, wherein the blocking element is formed by a blocking lever which is mounted so as to be pivotable relative to the frame.

6. The door-closing device according to claim 5, further comprising a separate pretensioning element associated with the blocking element for generating the restoring force.

7. The door-closing device according to claim 1, wherein the closing unit is formed by a rotary member which is rotatable about an axis of rotation which is stationary relative to the frame, and the axis of rotation of the rotary member extends at a radial distance from the path of movement of the keeper relative to the frame.

8. The door-closing device according to claim 7, wherein the rotary member has a radially protruding gripping section which grasps the keeper upon closure of the door, and draws the keeper further along in the direction of the path of movement of the keeper as the rotary member rotates.

9. The door-closing device according to claim 7 wherein the closing spring arrangement comprises at least one spiral spring which acts upon the rotary member and is loaded in tension or compression and a straight line of force of which, observed in a section normal to the axis of rotation, always lies on the same side of the axis of rotation, but is at a smaller radial distance from said axis of rotation in the open position than in the closing position.

10. The door-closing device according to claim 1 wherein the closing unit is formed by an individual closing body, that said closing body has a gripping section which grasps the keeper upon closure of the door, and draws said keeper along with itself while moving the closing body, the movement of the gripping section after the grasping of the keeper possessing an at least predominant component in the direction of the path of movement of said keeper.

* * * * *